US010654290B2

(12) United States Patent
Luan et al.

(10) Patent No.: US 10,654,290 B2
(45) Date of Patent: May 19, 2020

(54) LIQUID DISPENSING AMOUNT CONTROL APPARATUS AND CONTROL METHOD THEREOF AND INKJET PRINTING APPARATUS

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventors: Mengyu Luan, Beijing (CN); Youyuan Hu, Beijing (CN); Xinfeng Wu, Beijing (CN); Lin Chen, Beijing (CN); Bo Mao, Beijing (CN); Fei Li, Beijing (CN); Xinzhu Wang, Beijing (CN); Huihui Li, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei (CN)

( * ) Notice: Subject to any disclaimer, the term of this patent is extended or adjusted under 35 U.S.C. 154(b) by 0 days.

(21) Appl. No.: 16/122,472

(22) Filed: Sep. 5, 2018

(65) Prior Publication Data

US 2019/0061380 A1 Feb. 28, 2019

Related U.S. Application Data

(63) Continuation-in-part of application No. PCT/CN2018/081726, filed on Apr. 3, 2018.

(30) Foreign Application Priority Data

Aug. 23, 2017 (CN) ..... 2017 1 0731079

(51) Int. Cl.
*B41J 2/01* (2006.01)
*B41J 11/00* (2006.01)
*B41J 2/14* (2006.01)

(52) U.S. Cl.
CPC ..... *B41J 11/002* (2013.01); *B41J 2/14104* (2013.01); *B41J 2/14451* (2013.01)

(58) Field of Classification Search
None
See application file for complete search history.

(56) References Cited

U.S. PATENT DOCUMENTS 3,878,519 A * 4/1975 Eaton ..... B41J 2/02 347/75
6,022,098 A 2/2000 Fujii
(Continued)

FOREIGN PATENT DOCUMENTS

CN 1164654 A 11/1997
CN 106945278 A 7/2017
(Continued)

OTHER PUBLICATIONS

Office Action dated Jun. 27, 2019, issued in counterpart CN Application No. 2017107310799, with English translation (13 pages).
(Continued)

*Primary Examiner* — Matthew Luu
*Assistant Examiner* — Tracey M McMillion
(74) *Attorney, Agent, or Firm* — Westerman, Hattori, Daniels & Adrian, LLP

(57) ABSTRACT

The present disclosure is related to a liquid dispensing amount control apparatus. The liquid dispensing amount control apparatus may include at least one nozzle and at least one heating device. The heating device may be configured to heat a position of liquid dispensed from the nozzle to form a droplet.

13 Claims, 8 Drawing Sheets

(56) References Cited

U.S. PATENT DOCUMENTS

| | | | | |
|---|---|---|---|---|
| 6,258,405 | B1 | 7/2001 | Yamaguchi et al. | |
| 7,374,273 | B2 * | 5/2008 | Miura | B41J 2/14104 347/19 |
| 2012/0081451 | A1 | 4/2012 | Kondo et al. | |
| 2017/0182797 | A1 * | 6/2017 | Sugai | B41J 2/16517 |

FOREIGN PATENT DOCUMENTS

| | | | |
|---|---|---|---|
| CN | 106994830 | A | 8/2017 |
| CN | 107009738 | A | 8/2017 |
| CN | 107009739 | A | 8/2017 |
| EP | 0 867 284 | A2 | 9/1998 |
| EP | 0867284 | A2 | 9/1998 |
| JP | 2001-158099 | A | 6/2001 |
| JP | 2001158099 | A | 6/2001 |
| JP | 2007-90642 | A | 4/2007 |

OTHER PUBLICATIONS

Mun, Robert P. et al., "The effects of polymer concentration and molecular weight on the breakup of laminar capillary iets", Journal of Non-Newtonian Fluid Mechanics, vol. 74, 1998, pp. 285-297.
International Search Report dated Jul. 9, 2018, issued in countpart International Application No. PCT/CN2018/081726 (10 pages).

* cited by examiner

Prior Art

LIQUID DISPENSING AMOUNT CONTROL APPARATUS AND CONTROL METHOD THEREOF AND INKJET PRINTING APPARATUS

CROSS-REFERENCE TO RELATED APPLICATIONS

This application is a continuation of International Application No. PCT/CN2018/081726, filed on Apr. 3, 2018, the entire contents of which are incorporated herein by reference. This application claims benefit of the filing date of Chinese Patent Application No. 201710731079.9 filed on Aug. 23, 2017, the disclosure of which is hereby incorporated by reference.

TECHNICAL FIELD

This invention relates to printing technology, and more particularly, to a liquid dispensing amount control apparatus, a control method thereof, and an ink jet printing apparatus.

BACKGROUND

Inkjet printing technology is widely used in automotive, electronics, aerospace, medical engineering and other fields, and has become an important technology among modern advanced manufacturing technologies.

The key criterion for measuring quality of ink-jet printing is its uniformity of ink-jet volume. The uniformity of ink-jet volume in inkjet printing is mainly determined by three factors: first, control accuracy of the propulsion apparatus; second, uniformity of the ink jet liquid; and third, stability of the droplet formation. The propulsion apparatus can use high-precision equipment to improve the uniformity of the amount of each propulsion. The uniformity of the inkjet liquid can also be achieved by a variety of measures in a relatively short period of time to achieve a higher uniformity. However, the stability of the droplet formation is determined by many factors such as the uniformity of the solution, the structure of the nozzle, the power control apparatus, the distribution of working temperature, the working atmosphere, the liquid jet fluid force, and the state of the nozzle before jetting (e.g. liquid residue at the nozzle). Therefore, it is very difficult to control the stability of droplet formation, which makes it difficult to further improve the uniformity of the amount of ink discharged during inkjet printing.

BRIEF SUMMARY

Accordingly, one example of the present disclosure is a liquid dispensing amount control apparatus. The liquid dispensing amount control apparatus includes at least one nozzle and at least one heating device. The heating device may be configured to heat a position of liquid dispensed from the nozzle to form a droplet.

The at least one heating device may be at least one light irradiation device, wherein the light irradiation device may be configured to shine a light on a position of liquid dispensed from the nozzle to form a droplet. The light irradiation device may include a light source, a controller, and an adjuster. The light source may be configured to emit the light. The controller may be configured to calculate the position of the dispensed liquid where the light shines to form the droplet based on an amount of the liquid required for the droplet. The adjuster may be configured to adjust the light emitted from the light source to shine on the calculated position of the dispensed liquid. The light source may be an infrared light source or an ultraviolet light source or a laser.

In one embodiment, the liquid dispensing amount control apparatus may include a plurality of nozzles and a plurality of light irradiation devices. Each of the plurality of the light irradiation device may be configured to shine a light on a position of the liquid dispensed from one of the plurality of the nozzles respectively to form a droplet. Each of the light irradiation devices may include a point light source. The droplet formed from each of the plurality of the nozzles may have substantially the same amount of liquid.

In one embodiment, liquid dispensing amount control apparatus may include a plurality of nozzles arranged in a line and a light irradiation device. The light irradiation device may be configured to shine a light on a position of liquid dispensed from each of the nozzles to form droplets. The light irradiation device may include a linear light source. The droplets formed from the plurality of the nozzles may have substantially the same amount of liquid.

The adjuster may be an angle conversion device. The angle conversion device may be a piezoelectric ceramic control element, wherein one end of the piezoelectric ceramic control system may be fixedly connected with one end of the light source.

The at least one heating device may be at least one circular flash heating device, and the circular flash heating device may be configured to heat a position of liquid dispensed from the nozzle to form a droplet.

Another example of the present disclosure is an ink-jet printing apparatus. The ink-jet printing apparatus may include a liquid dispensing amount control apparatus according to one embodiment of the present disclosure.

Another example of the present disclosure is a controlling method for the liquid dispensing amount control apparatus. The method may include dispensing the liquid from the nozzle and heating a position of the dispensed liquid to form a droplet. Heating the position of the dispensed liquid to form a droplet may include shining a light on the position of the dispensed liquid to form the droplet. The step of shining the light on the position of the dispensed liquid may include the steps of calculating the position of the dispensed liquid where the light shines to form the droplet based on an amount of liquid required for the droplet and adjusting the light emitted from the light source of the light irradiation device to shine on the calculated position of the dispensed liquid. The light irradiation device may include a point light source, and each point light source may shine a light on a position of dispensed liquid from one of a plurality of nozzles respectively. The light irradiation device may include a linear light source, and the linear light source may shine a light on a position of dispensed liquid from each of a plurality of nozzles. Calculating the position of the dispensed liquid where the light shines to form the droplet based on an amount of liquid required for the droplet may include selecting a nozzle having a diameter based on liquid viscosity and targeted liquid volume so that a droplet volume obtained by the substrate approaches and slightly exceeds V0 without the aid of illumination and turning on the light source and adjusting the light position. Adjusting the light position may include adjusting the light position initially to the lower position of the liquid column, and measuring a volume of an droplet obtained on the substrate $V_m$ and shifting the light position upwards until $V_m$ is equal to V0.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

Figure 1A:
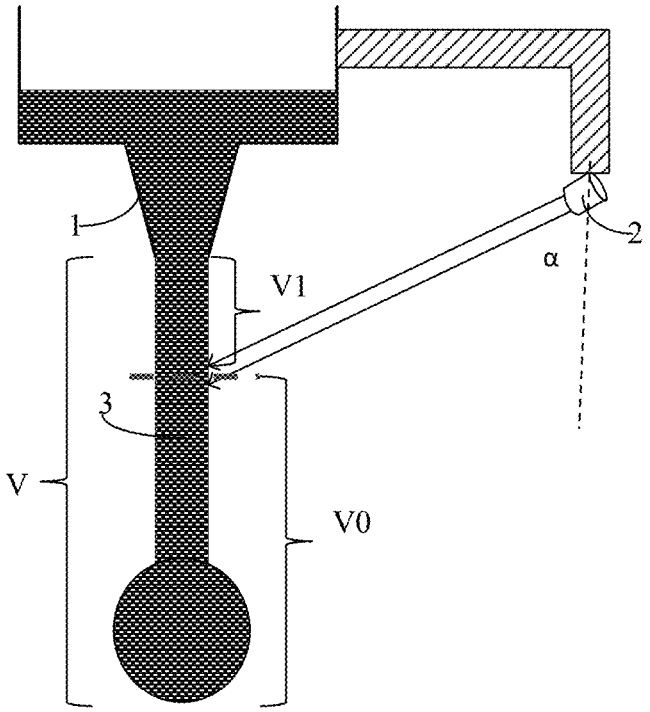
FIG. 1A is a schematic diagram of an liquid dispensing amount control apparatus according to one embodiment of the present disclosure.

The present disclosure will be described in further detail with reference to the accompanying drawings and embodiments in order to provide a better understanding by those skilled in the art of the technical solutions of the present disclosure. Throughout the description of the disclosure, reference is made to FIGS. 1A-6. When referring to the figures, like structures and elements shown throughout are indicated with like reference numerals.

One embodiment of the present disclosure is a liquid dispensing amount control apparatus. The liquid dispensing amount control apparatus include at least one nozzle and at least one heating device. The heating device is configured to heat a position of liquid dispensed from the nozzle to form a droplet.

In one embodiment, as shown in FIG. 1A, the liquid dispensing amount control apparatus comprises a nozzle 1 for dispensing liquid, a light irradiation device 2 for shining light to a corresponding position of the liquid 3 dispensed from the nozzle 1 so that the liquid 3 necks at the position where the light shines to form a liquid droplet with a predetermined amount of liquid.

Necking refers to phenomenon of partial cross-section reduction of liquid material under tensile stress and gravity. The arrangement of the light irradiation device 2 allows the liquid 3 dispensed from the nozzle 1 to rise in temperature locally at the irradiation position so that the liquid 3 necks at the irradiation position and forms a droplet, thereby controlling the amount of liquid in the droplet and accordingly achieving uniform dispensing amount of the liquid from the nozzle 1.

Figure 2:
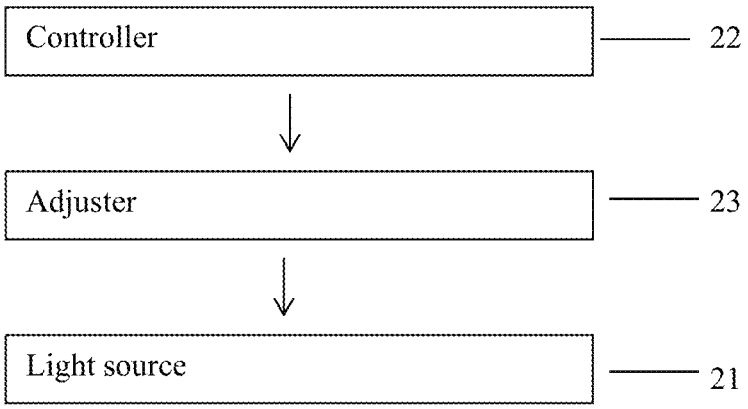
FIG. 2 is a block diagram of a light irradiation device according to one embodiment of the present disclosure.

In one embodiment, as shown in FIG. 2, the light irradiation device 2 includes a light source 21, a controller 22, and an adjuster 23. The controller 22 is connected to the adjuster 23. The adjuster 23 is connected to the light source 21. The light source 21 is configured to emit irradiation light of a predetermined frequency. The controller 22 is used for calculating the irradiation position of the light on the liquid 3 dispensed by the nozzle 1 based on the predetermined amount of the liquid in the droplet. The adjuster 23 is used for adjusting the irradiation position of the light emitted from the light source 21 on the dispensed liquid 3 from the nozzle 1 based on the calculation result of the controller 22.

The light source 21 may emit infrared light, ultraviolet light, or laser. The light source 21 is not limited to those emitting infrared light or ultraviolet light, and other light sources 21 capable of necking the liquid 3 at the irradiated position may be used as long as the light of the predetermined frequency emitted from the light source 21 does not cause material of the liquid 3 emitted from the nozzle 1 to denature. The predetermined amount requirement for a droplet refers to the requirement for the mass and volume that form the droplet. The controller 22 can calculate the irradiation position of the light beam on the liquid column for forming a droplet with a predetermined amount of liquid based on the concentration of the liquid, the diameter of the nozzle 1, and the diameter of the discharged liquid column.

In one embodiment, the calculation process may be as follows:

As shown in FIG. 1A, the amount of liquid that falls on the substrate is defined as V0, the target liquid volume. The amount of liquid discharged at a time by the power system (piezoelectric power device) is defined as V, where it can be freely changed by adjusting the power system. V1 is the amount of liquid rebound at the end of each liquid ejection. The volume of liquid V0 can be adjusted in two ways:

1. When the light position is fixed, the volume of V is increased by increasing the pushing force of the power system. After increasing the volume of V, the volume of V1 and V0 will both increase. This method is suitable for larger volume adjustment.

2, when the pushing force of the power system is fixed, V is the same. By adjusting the light position, the ratio of V1 and V0 is changed. As such, the volume of V0 is changed. This method is suitable for smaller volume adjustment.

In general, in addition to the power system, the amount of liquid ejected is also affected by the size of the nozzle and the liquid viscosity. Among them, the size of the nozzle can adjust the amount of liquid in a larger range, and the selection of the nozzle will be affected by the viscosity of the liquid. When the liquid viscosity is small, the size of a nozzle cannot be too large. The amount of liquid can be calculated as follows:

In step 1, according to the liquid viscosity and the targeted liquid volume, a suitable nozzle size is selected and the power system is adjusted so that the droplet volume V obtained by the substrate approaches and slightly exceeds V0 without the aid of illumination.

In step 2, the light is turned on, and the light position is adjusted to the lower position of the liquid column. The volume of the droplet obtained on the substrate at this time is measured, which is as $V_m$. At this time, it is divided into two cases:

In step 2.1, if the $V_m$ is less than V0, then the light position is fine-tuned, so that the light position is shifted upwards until the $V_m$ is equal to V0. When step 1 is completed, the $V_m$ is greater than V0, and when the illumination is turned on and the illumination position is lower, the $V_m$ is less than V0. Therefore, moving illumination position upwards may reach a position where $V_m$ is equal to V0.

In step 2.2, if the $V_m$ is greater than V0, indicating that the power system is not enough. The power system needs to be adjusted to reduce the size of the entire droplet. After adjustment, the process returns to step 2.1.

Figure 1B:
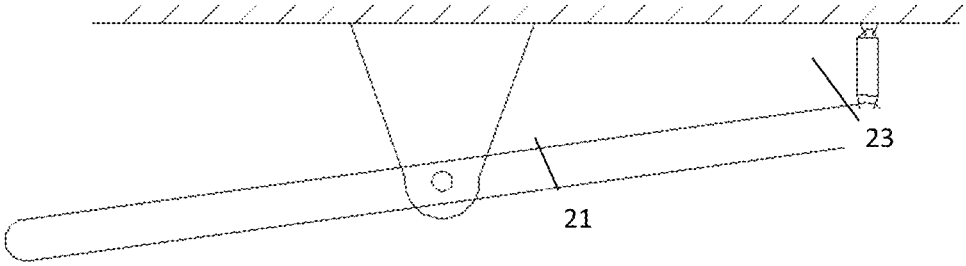
FIG. 1B is a schematic diagram of an adjuster according to one embodiment of the present disclosure.

The adjuster 23 can either automatically adjust the irradiation position of the light emitted by the light source 21 or manually adjust the irradiation position of the light emitted by the light source 21. For example, the adjuster 23 may adopt an angle conversion device which can adjust the irradiation position of the light on the liquid 3 by adjusting the irradiation angle α of the light of the light source 21, as shown in FIG. 1A and FIG. 1B. The specific structure of the adjuster 23 is not limited as long as the irradiation position of the light on the liquid 3 can be adjusted. In one embodiment, as shown in FIG. 1B, the adjuster is a piezoelectric ceramic control element. One end of the piezoelectric ceramic is fixedly connected with one end of the light source. By controlling the expansion and contraction of the piezoelectric ceramic, the light source can be turned within a small range.

Figure 1C:
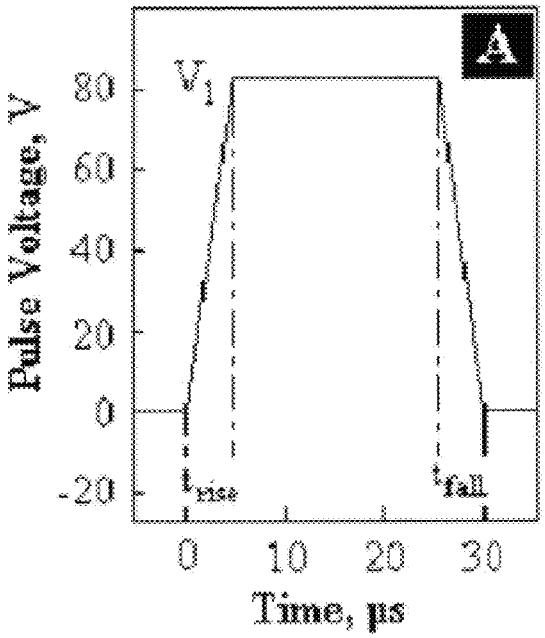
FIG. 1C is an electrical signal waveform for piezoelectric ceramics in the prior art.

FIG. 1C shows an electrical signal waveform for piezoelectric ceramics. In the range of 0 to 10 microseconds, the volume of the piezoelectric ceramic is getting bigger. In the range of 10 to 20 microseconds, the volume of the piezoelectric ceramic is kept constant. In the range of 20 to 30 microseconds, the volume of the piezoelectric ceramic shrinks back. In one embodiment, the illumination time should be controlled in the range of 10 to 20 microseconds. For example, the illuminate time can be in the range of 13 to 16 microseconds.

In one embodiment, the liquid dispensing amount control apparatus is applied to control the dispensing amount of a high-viscosity liquid. Due to the large surface tension of the high viscosity liquid, it is not easy for the necking to form droplets, so it is difficult to control the dispensing amount of the liquid with high viscosity. By using the liquid dispensing amount control apparatus according to one embodiment of the present disclosure, the high-viscosity liquid dispensed from the nozzle 1 can be forced to neck at the corresponding position by the light irradiation device 2, so that the high-viscosity liquid can smoothly form a droplet with a predetermined amount of liquid, and accordingly uniformity of the dispensing amount of the high viscosity liquid can be improved.

In the prior art, the liquid droplet dispensed from the nozzle is formed by a pulse rebound method. When a liquid droplet is formed, a part of the liquid that is dispensed from the nozzle is sucked back into the nozzle by liquid surface tension, thereby achieving the separation of the dispensed liquid at a certain position to form the droplet. In the pulse rebound mode, before separating at the certain position of the liquid to form the droplet, the upper part of the liquid near the nozzle and the lower part of the liquid far away from the nozzle have different velocities, thereby resulting in tailing of the lower part of the liquid. As a result, the lower part of the liquid forms satellite spots at the landing site after separation from the upper part of the liquid. Compared with the pulse rebound method in the prior art, the light irradiation device 2 according to one embodiment of the present disclosure can cause the liquid to neck down at the corresponding position to form a droplet in a light and thermal-induced manner, thereby preventing the liquid at the upper and lower part of neck from having different velocities, and accordingly avoiding the formation of the satellite spots at the landing site and improving stability of the droplet formation and uniformity of the dispensing amount.

Another embodiment of the present disclosure is a method for controlling the dispensing amount of the liquid from the liquid dispensing amount control apparatus. According to one embodiment of the present disclosure, the method includes dispensing the liquid from the nozzle, and shining a light from the light irradiation device on a corresponding position of the liquid dispensed from the nozzle so that the liquid is necked at the position shined with the light to form a liquid droplet with a predetermined amount of the liquid.

The method may further include calculating the position of the dispensed liquid where the light shines based on the predetermined amount of liquid for the droplet and adjusting the light emitted from the light irradiation device to shine on the position of the liquid dispensed from the nozzle based on the calculation result of the irradiation position.

In the liquid dispensing amount control apparatus according to one embodiment of the present disclosure, by providing the light irradiation device, the liquid dispensed from the nozzle can be locally warmed at its irradiated position so that the liquid is necked at the irradiated position to form the droplet. As such, it is possible to control the amount of liquid in the droplet, and accordingly improve uniformity of the amount of liquid discharged from the nozzle.

Figure 3:
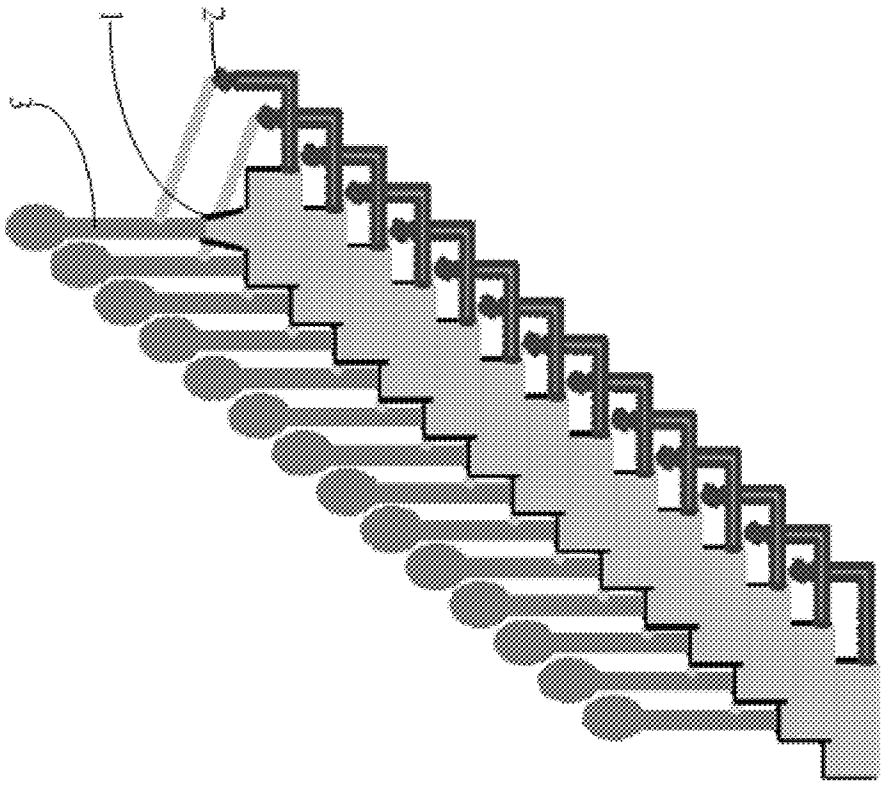
FIG. 3 is a schematic diagram of a liquid dispensing amount control apparatus according to one embodiment of the present disclosure.

FIG. 3 shows a liquid dispensing amount control apparatus according to one embodiment of the present disclosure. As shown in FIG. 3, the liquid dispensing amount control apparatus comprises a plurality of nozzles 1 and a plurality of light irradiation devices 2. Each of the light irradiation devices corresponds to one of the nozzles, respectively. Each of the light irradiation devices is used for controlling the corresponding nozzle to dispense a predetermined amount of the liquid to form the droplet. The light sources are point light sources.

In one embodiment, the light emitted by each of the light sources irradiates the liquid 3 dispensed from one of the nozzles 1 respectively, thereby realizing the independent control of the dispensing amount of each of the nozzles 1 and, at the same time, improving the uniformity of the dispensing amount of all the nozzles 1.

The irradiation positions of the point light sources on the liquid 3 dispensed from each of the nozzles 1 may be the same. For example, when each of the nozzles 1 dispenses the same type of liquid 3, the irradiation positions of the point light sources on the dispensed liquid 3 of the nozzles 1 are the same. As such, it is possible to control uniformity of the dispensing amount of the liquid from all the nozzles 1.

The irradiation positions of the point light sources on the liquid 3 dispensed from the nozzles 1 may also be different. For example, when each of the nozzles 1 dispenses a different type of liquid 3, the irradiation positions of the light sources on the liquid from each of the nozzles are different for each of the point light sources to ensure that the same amount of different liquid is dispensed from each of the nozzles to form the droplets.

By providing a plurality of the light irradiation devices 2, it is possible to control the dispensing amount of the plurality of nozzles 1 to be uniform, thereby achieving uniform dispensing amount of the liquid dispensing amount control apparatus provided with a plurality of nozzles 1.

Another embodiment of the present disclosure is a method for controlling the dispensing amount of the liquid from the liquid dispensing amount control apparatus. On the basis of the method for controlling the amount of liquid dispensed in Embodiment 1, the light sources of the light irradiation device in this embodiment are point light sources, and each of the point light sources irradiates the liquid from one of the nozzles respectively.

Other structures of the liquid dispensing amount control apparatus and other steps of the liquid dispensing amount control method in this embodiment are similar as those in Embodiment 1, and the details are not described herein again.

Figure 4:
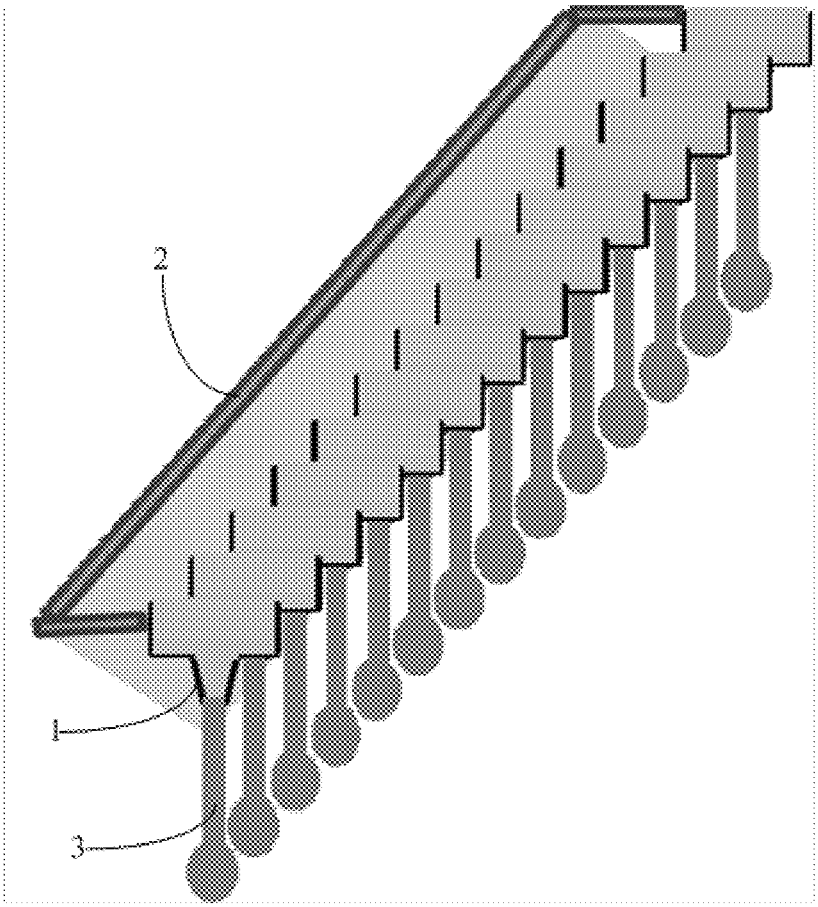
FIG. 4 is a schematic diagram of a liquid dispensing amount control apparatus according to one embodiment of the present disclosure.

FIG. 4 shows a liquid dispensing amount control apparatus according to one embodiment of the present disclosure. As shown in FIG. 4, the liquid dispensing amount control apparatus comprises a plurality of nozzles 1 arranged in a line and a light irradiation device 2. The light irradiation device 2 corresponds to the plurality of nozzles 1. The light irradiation device 2 is used for controlling dispensing a predetermined amount of liquid to form droplets from all the nozzles 1.

The light source is a linear light source, and the light emitted from the linear light source is correspondingly irradiated onto the liquid 3 dispensed from all the nozzles 1. The irradiation position of the linear light source on the liquid 3 dispensed from each of the nozzles 1 may be the same. For example, when each of the nozzles 1 is used for dispensing the same type of liquid 3, the irradiation positions of the linear light source on the liquid 3 dispensed by each of the nozzles 1 are the same, thereby controlling the dispensing amount of each of the nozzles 1 and improving uniformity of the dispensing amount of liquid from all the nozzles 1.

The irradiation positions of the linear light source on the liquid 3 dispensed from each of the nozzles 1 may also be different. For example, when each of the nozzles 1 dispenses a different type of liquid 3, the irradiation positions of the linear light source on the liquid from each of the nozzles are different to ensure that the same amount of different liquid is dispensed from each of the nozzles to form the droplets.

By providing the light irradiation device 2, it is possible to control the dispensing amount of the plurality of nozzles 1 to be uniform, thereby achieving uniform dispensing amount of the liquid dispensing amount control apparatus provided with a plurality of nozzles 1.

Figure 5:
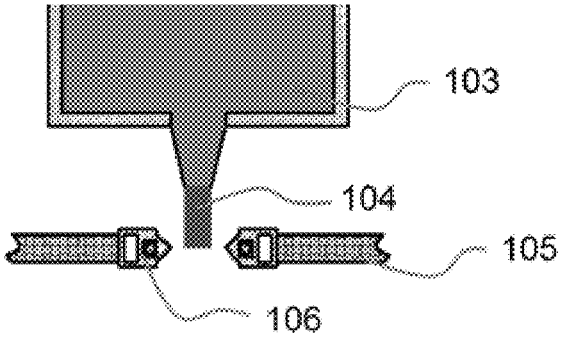
FIG. 5 is a schematic diagram of an liquid dispensing amount control apparatus according to one embodiment of the present disclosure.
Figure 6:
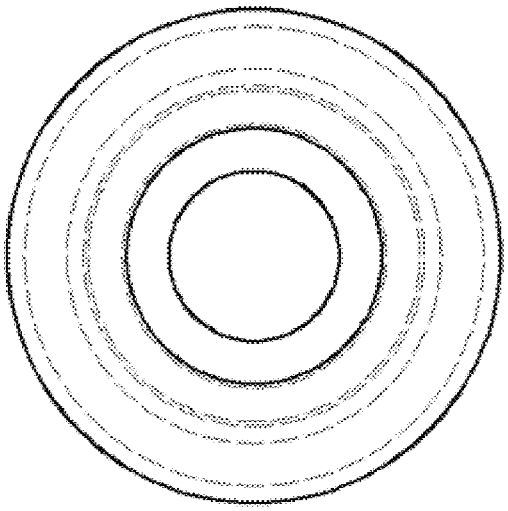
FIG. 6 is a top view of a flash heating device according to one embodiment of the present disclosure.

FIG. 5 is a schematic diagram of a liquid dispensing amount control apparatus according to one embodiment of the present disclosure. As shown in FIG. 5, the at least one heating device is a circular flash heating device 106. The circular flash heating device is configured to heat a position of liquid dispensed from the nozzle to form a droplet. The flash heating device is supported by a supporting device 105. The liquid 103 flows out of the nozzle to form a liquid column 104. The liquid column 104 from the nozzle passes through the center of the circular flash heating device. FIG. 6 shows a top view of a flash heating device according to one embodiment of the present disclosure. The flash heating device may include a resistor capable of being heated by electricity. Another embodiment of the present disclosure is a method for controlling the dispensing amount of the liquid from the liquid dispensing amount control apparatus according to the above embodiment of the present disclosure. On the basis of the method for controlling the amount of liquid dispensed in Embodiment 1, the light source of the light irradiation device in this embodiment is a linear light source, and the linear light source irradiates the liquid dispensed from the plurality of the nozzles correspondingly.

Other structures of the liquid dispensing amount control apparatus and other steps of the liquid dispensing amount control method in this embodiment are similar as those in Embodiment 1, and the details are not described herein again.

In the liquid dispensing amount control apparatus according to one embodiment of the present disclosure, by providing the light irradiation device, the liquid dispensed from the nozzle can be locally warmed at its irradiated position so that the liquid is necked at the irradiated position to form the droplet. As such, it is possible to control the amount of liquid in the droplet, and accordingly improve uniformity of the amount of liquid discharged from the nozzle.

Embodiment 4

Another embodiment of the present disclosure is an ink jet printing apparatus comprising the liquid dispensing amount control apparatus according to one embodiment of the present disclosure.

By employing the liquid dispensing amount control apparatus according to one embodiment of the present disclosure, the uniformity of the dispensing amount of the ink-jet printing apparatus is improved, thereby improving the printing quality of the ink-jet printing apparatus.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A liquid dispensing amount control apparatus comprising:

at least one nozzle; and at least one heating device, wherein the heating device is configured to heat a position of liquid dispensed from the nozzle to form a droplet, the at least one heating device is at least one light irradiation device, wherein the light irradiation device is configured to shine a light on the position of liquid dispensed from the nozzle to form the droplet, the light irradiation device comprises a light source, a controller, and an adjuster, wherein the light source is configured to emit the light;

wherein the controller is configured to calculate the position of the dispensed liquid where the light shines to form the droplet based on an amount of the liquid required for the droplet; and wherein the adjuster is configured to adjust the light emitted from the light source to shine on the calculated position of the dispensed liquid, the adjuster is an angle conversion device, and the angle conversion device is a piezoelectric ceramic control element, wherein one end of the piezoelectric ceramic control system is fixedly connected with one end of the light source.

2. The liquid dispensing amount control apparatus according to claim 1, wherein the light source is an infrared light source or an ultraviolet light source or a laser.

3. The liquid dispensing amount control apparatus according to claim 2, wherein the droplet formed from each of the plurality of the nozzles has substantially the same amount of liquid.

4. The liquid dispensing amount control apparatus according to claim 1, further comprising a plurality of nozzles and a plurality of light irradiation devices, wherein each of the plurality of the light irradiation device is configured to shine a light on a position of the liquid dispensed from one of the plurality of the nozzles respectively to form a droplet.

5. The liquid dispensing amount control apparatus according to claim 4, wherein each of the light irradiation devices comprises a point light source.

6. The liquid dispensing amount control apparatus according to claim 1, further comprising a plurality of nozzles arranged in a line and a light irradiation device, wherein the light irradiation device is configured to shine a light on a position of liquid dispensed from each of the nozzles to form droplets.

7. The liquid dispensing amount control apparatus according to claim 6, wherein the light irradiation device comprises a linear light source.

8. The liquid dispensing amount control apparatus according to claim 6, wherein the droplets formed from the plurality of the nozzles have substantially the same amount of liquid.

9. An ink-jet printing apparatus, comprising the liquid dispensing amount control apparatus according to claim 1.

10. A controlling method for the liquid dispensing amount control apparatus according to claim 1, comprising the steps of:

dispensing the liquid from the nozzle; and heating a position of the dispensed liquid to form a droplet, wherein heating the position of the dispensed liquid to form a droplet comprises:

shining a light on the position of the dispensed liquid to form the droplet, and the step of shining the light on the position of the dispensed liquid comprises the steps of:

calculating the position of the dispensed liquid where the light shines to form the droplet based on an amount of liquid required for the droplet; and adjusting the light emitted from the light source of the light irradiation device to shine on the calculated position of the dispensed liquid.

11. The controlling method for the liquid dispensing amount control apparatus according to claim 10, the light irradiation device comprises a point light source, and each point light source shines a light on a position of dispensed liquid from one of a plurality of nozzles respectively.

12. The controlling method for the liquid dispensing amount control apparatus according to claim 10, wherein the light irradiation device comprises a linear light source, and the linear light source shines a light on a position of dispensed liquid from each of a plurality of nozzles.

13. The controlling method for the liquid dispensing amount control apparatus according to claim 10, wherein calculating the position of the dispensed liquid where the light shines to form the droplet based on an amount of liquid required for the droplet comprises:

selecting a nozzle having a diameter based on liquid viscosity and targeted liquid volume so that a droplet volume obtained by the substrate approaches and slightly exceeds V0 without the aid of illumination; and turning on the light source and adjusting the light position.

* * * * *